US009107273B2

(12) United States Patent
Lenk et al.

(10) Patent No.: US 9,107,273 B2
(45) Date of Patent: Aug. 11, 2015

(54) END-OF-LIFE BULB CIRCUITRY

(75) Inventors: Ronald J. Lenk, Woodstock, GA (US); Carol Lenk, Woodstock, GA (US); Ethan Thorman, Palo Alto, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 680 days.

(21) Appl. No.: 13/062,195

(22) PCT Filed: Sep. 8, 2009

(86) PCT No.: PCT/US2009/005021

§ 371 (c)(1),
(2), (4) Date: Apr. 28, 2011

(87) PCT Pub. No.: WO2010/030332

PCT Pub. Date: Mar. 18, 2010

(65) Prior Publication Data

US 2011/0210669 A1 Sep. 1, 2011

Related U.S. Application Data

(60) Provisional application No. 61/096,253, filed on Sep. 11, 2008.

(51) Int. Cl.
*H05B 37/02* (2006.01)
*H05B 33/08* (2006.01)

(52) U.S. Cl.
CPC ..... *H05B 33/0893* (2013.01)

(58) Field of Classification Search
USPC ..... 315/360, 361, 291, 293–295, 312, 307, 315/308
See application file for complete search history.

(56) References Cited

U.S. PATENT DOCUMENTS

| | | | | |
|---|---|---|---|---|
| 5,126,634 | A | 6/1992 | Johnson | |
| 5,274,611 | A | 12/1993 | Donohoe | |
| 5,296,783 | A | 3/1994 | Fischer | |
| 5,666,029 | A * | 9/1997 | McDonald | 315/86 |
| 5,835,361 | A | 11/1998 | Fitzgerald | |
| 6,094,362 | A | 7/2000 | Domingo | |
| 6,281,642 | B1 * | 8/2001 | Konishi et al. | 315/308 |
| 6,348,766 | B1 * | 2/2002 | Ohishi et al. | 315/200 A |
| 6,362,573 | B1 | 3/2002 | Helbing et al. | |
| 6,456,015 | B1 | 9/2002 | Lovell et al. | |
| 6,504,301 | B1 | 1/2003 | Lowery | |
| 6,612,712 | B2 | 9/2003 | Nepil | |

(Continued)

FOREIGN PATENT DOCUMENTS

| | | |
|---|---|---|
| EP | 0658933 B1 | 10/2001 |
| JP | 07-99372 A | 4/1995 |

(Continued)

OTHER PUBLICATIONS

International Search Report received for PCT Patent Application No. PCT/US2009/004661, mailed on Oct. 2, 2009, 2 pages.

(Continued)

*Primary Examiner* — Douglas W Owens
*Assistant Examiner* — James H Cho
(74) *Attorney, Agent, or Firm* — Morrison & Foerster LLP

(57) ABSTRACT

An LED light bulb which turns itself permanently off when it reaches the end of its useful life, and more particularly, to a scheme which slightly varies the end-of-life condition from unit to unit.

7 Claims, 2 Drawing Sheets

(56) References Cited

U.S. PATENT DOCUMENTS

| | | | | |
|---|---|---|---|---|
| 6,639,360 | B2 | 10/2003 | Roberts et al. | |
| 6,717,374 | B2 | 4/2004 | Krummel | |
| 6,791,259 | B1 | 9/2004 | Stokes et al. | |
| 7,075,112 | B2 | 7/2006 | Roberts et al. | |
| 7,078,732 | B1 | 7/2006 | Reeh et al. | |
| 7,213,934 | B2 | 5/2007 | Zarian et al. | |
| 7,276,861 | B1 | 10/2007 | Shteynberg et al. | |
| 7,288,798 | B2 | 10/2007 | Chang et al. | |
| 7,319,293 | B2 | 1/2008 | Maxik | |
| 7,344,279 | B2 | 3/2008 | Mueller et al. | |
| 7,358,679 | B2 | 4/2008 | Lys et al. | |
| 7,489,031 | B2 | 2/2009 | Roberts et al. | |
| 7,863,831 | B2 | 1/2011 | Vos | |
| 7,986,107 | B2 | 7/2011 | Weaver et al. | |
| 2002/0005697 | A1* | 1/2002 | Morgan et al. | 315/291 |
| 2002/0149312 | A1 | 10/2002 | Roberts et al. | |
| 2004/0004435 | A1 | 1/2004 | Hsu | |
| 2004/0113549 | A1 | 6/2004 | Roberts et al. | |
| 2004/0264192 | A1 | 12/2004 | Nagata et al. | |
| 2005/0084229 | A1 | 4/2005 | Babbitt et al. | |
| 2005/0179379 | A1 | 8/2005 | Kim | |
| 2005/0224829 | A1 | 10/2005 | Negley et al. | |
| 2005/0243539 | A1 | 11/2005 | Evans et al. | |
| 2005/0243552 | A1 | 11/2005 | Maxik | |
| 2006/0038511 | A1* | 2/2006 | Tagawa | 315/291 |
| 2006/0145172 | A1 | 7/2006 | Su et al. | |
| 2006/0176699 | A1 | 8/2006 | Crunk | |
| 2006/0187653 | A1 | 8/2006 | Olsson | |
| 2006/0244396 | A1 | 11/2006 | Bucur | |
| 2006/0274524 | A1 | 12/2006 | Chang et al. | |
| 2007/0001623 | A1* | 1/2007 | Dudley | 315/291 |
| 2007/0040696 | A1* | 2/2007 | Mubaslat et al. | 340/657 |
| 2007/0090391 | A1 | 4/2007 | Diamantidis | |
| 2007/0090737 | A1 | 4/2007 | Hu et al. | |
| 2007/0120507 | A1 | 5/2007 | Uchida et al. | |
| 2007/0228999 | A1 | 10/2007 | Kit | |
| 2007/0291490 | A1 | 12/2007 | Tajul et al. | |
| 2008/0013316 | A1 | 1/2008 | Chiang | |
| 2008/0013324 | A1 | 1/2008 | Yu | |
| 2008/0024070 | A1 | 1/2008 | Catalano et al. | |
| 2008/0198615 | A1 | 8/2008 | Klipstein | |
| 2008/0265789 | A1* | 10/2008 | Bertram et al. | 315/185 R |
| 2009/0001372 | A1 | 1/2009 | Arik et al. | |
| 2010/0109557 | A1 | 5/2010 | Bouchard | |
| 2010/0308739 | A1 | 12/2010 | Shteynberg et al. | |
| 2011/0084615 | A1 | 4/2011 | Welten | |
| 2011/0163680 | A1 | 7/2011 | Welten | |
| 2011/0248644 | A1 | 10/2011 | Welten et al. | |

FOREIGN PATENT DOCUMENTS

| | | | |
|---|---|---|---|
| JP | 3351103 | B2 | 11/2002 |
| WO | 02/061805 | A2 | 8/2002 |
| WO | 2005/060309 | A2 | 6/2005 |
| WO | 2007/069119 | A1 | 6/2007 |

OTHER PUBLICATIONS

International Search Report received for PCT Patent Application No. PCT/US2009/004663, mailed on Sep. 22, 2009, 2 pages.

International Search Report received for PCT Patent Application No. PCT/US2009/005021, mailed on Oct. 16, 2009, 2 pages.

International Search Report received for PCT Patent Application No. PCT/US2009/005022, mailed on Nov. 2, 2009, 2 pages.

International Preliminary Report on Patentability received for PCT Patent Application No. PCT/US2009/004661, mailed on Mar. 3, 2011, 6 pages.

International Preliminary Report on Patentability received for PCT Patent Application No. PCT/US2009/004663, mailed on Mar. 3, 2011, 6 pages.

International Preliminary Report on Patentability received for PCT Patent Application No. PCT/US2009/005021, mailed on Mar. 24, 2011, 5 pages.

International Preliminary Report on Patentability received for PCT Patent Application No. PCT/US2009/005022, mailed on Mar. 24, 2011, 6 pages.

Non Final Office Action received for U.S. Appl. No. 12/625,486, mailed on Nov. 14, 2011, 16 pages.

Non Final Office Action received for U.S. Appl. No. 12/561,514, mailed on Jan. 27, 2012, 11 pages.

* cited by examiner

END-OF-LIFE BULB CIRCUITRY

CROSS REFERENCE TO RELATED APPLICATIONS

This is a U.S. National Phase patent application of PCT/US2009/005021, filed Sep. 8, 2009, which claims priority to U.S. patent application Ser. No. 61/096,253, filed Sep. 11, 2008, all of which are hereby incorporated by reference in the present disclosure in their entirety.

FIELD OF THE INVENTION

The present invention relates to LED light bulbs which turn themselves permanently off when they reach the end of their useful life, and more particularly, to a scheme which slightly varies the end-of-life condition from unit to unit, or light bulb to light bulb.

BACKGROUND OF THE INVENTION

There are three major technologies used for light bulbs today: incandescent, fluorescent and LED. Both incandescent and fluorescent bulbs have a well-defined end-of-life. This occurs when the filament breaks, and they cease producing light. Traditionally, for a plurality of light bulbs, "end-of-life" of both incandescent and fluorescent bulbs refers to the time when 50% of a population of them no longer emits light. In addition, because of the careful design of these bulbs, their end-of-life also corresponds to a specific level of light loss, which ensures that when the bulb needs to be replaced, it is at approximately the lowest acceptable level of light output.

However, because of the physical nature of the failure mode, there is naturally some distribution of failure times around this mean, which is convenient in application, as it means that not all the bulbs in a given install cycle fail simultaneously which might potentially cause under-lighting.

In the case of LED bulbs, failures are rare and occur after a very long time. Instead, the industry has chosen to define "end-of-life" for an LED bulb as the time at which it produces noticeably less light than initially, presently defined as 70% of initial lumens.

For many applications, the very long life time of LED bulbs is an advantage. Typically, most of these applications do not require replacing the bulb just because some degradation in light has occurred. However, there are other applications in which a minimum light level is required. For example, work and/or office areas can require a certain light level to ensure productivity, and/or a certain light level to avoid eye strain among office workers.

It can be appreciated that in circumstances such as these, it would be desirable to have the ability to turn off the LED light bulb when a specified level of light loss is reached. In addition, in order to avoid having all or a majority of light bulbs in an area turn off simultaneously, it would be desirable to have a variation and/or distribution of turn off times (i.e., end-of-life) of the light bulbs.

SUMMARY OF THE INVENTION

This invention has the object of developing an apparatus with a controllable end-of-life such that the above-described primary problem is effectively solved. In accordance with an exemplary embodiment, it would be desirable to provide an LED light bulb that after a predetermined amount of time turns itself off, and wherein the predetermined time is variable or has some variation thereto. In accordance with an exemplary embodiment, the apparatus includes an LED light bulb, a circuit for counting AC line cycles, a non-volatile memory for maintaining a record of the bulb operational time while the bulb is off, and a circuit to shut off the bulb when a preset amount of operational time has passed.

In accordance with one embodiment, a microcontroller counts AC line cycles using a resistor divider from the rectified AC line and an edge-triggered digital input. Every time the line voltage crosses some threshold, the resistor divider output triggers the digital input of the microcontroller, causing it to increment an internal counter by one. The counter may be preferentially arranged to have enough bits to count line cycles during the entire operational lifetime of the bulb.

During the time that the bulb is not energized, the counter value may be offloaded to a non-volatile memory, preferentially also inside the microcontroller. When the bulb is first turned on, the value in the non-volatile memory may be downloaded to the counter, so that the count continues from where it last left off. In accordance with an exemplary embodiment, the power circuitry inside the bulb can be designed such that when power is cut to the bulb, sufficient energy remains stored in an internal capacitor for the microcontroller to offload the counter to the non-volatile memory so that the count is not lost.

When the counter value reaches a predetermined value set in the microcontroller's program, the bulb is turned off. If the bulb is turned on when the predetermined value has already been reached, the bulb fails to turn on, which ensures that once the bulb is "dead" (i.e., the bulb has reached the end of its useful life or "end-of-life"), it remains "dead".

Finally, the predetermined value may be set to varying values in various bulbs in the factory. For example, a period of one month could be set as the distribution of end-of-life times, with 10% of the light bulbs coming off the line being in the first tenth of that period, 10% of the light bulbs coming off the line being in the second tenth of that period and so on. By staggering or varying the time (or periods) in which light bulbs reach their end-of-life, this ensures that no more than approximately one tenth of the light bulbs will fail at any one time, reducing light output by only one tenth, and ensuring that there is adequate time to replace all of the light bulbs.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
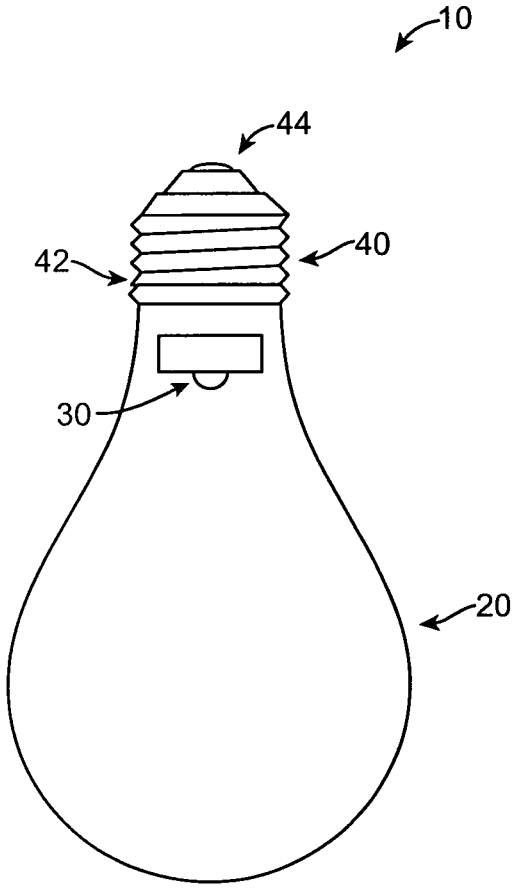
FIG. 1 is a cross-sectional view of a LED light bulb in accordance with an embodiment.

Reference will now be made in detail to the present preferred embodiments of the invention, examples of which are illustrated in the accompanying drawings. Wherever possible, the same reference numbers are used in the drawings and the description to refer to the same or like parts.

According to the design characteristics, a detailed description of the current practice and preferred embodiments is given below.

FIG. 1 shows a cross-sectional view of an LED light bulb 10 showing the shell (or bulb) 20 enclosing an LED (light-emitting diode) 30 according to one embodiment. The light bulb 10 includes a screw-in base 40, which includes a series of screw threads 42 and a base pin 44. The screw-in base 40 is configured to fit within and make electrical contact with a standard electrical socket (not shown). The electrical socket is preferably dimensioned to receive an incandescent or other standard light bulb as known in the art. However, it can be appreciated that the screw-in base 40 can be modified to fit within any electrical socket, which is configured to receive a light bulb, such as a bayonet style base. In use, the screw-in base 40 makes electrical contact with the AC power in a socket through its screw threads 42 and its base pin 44.

Figure 2:
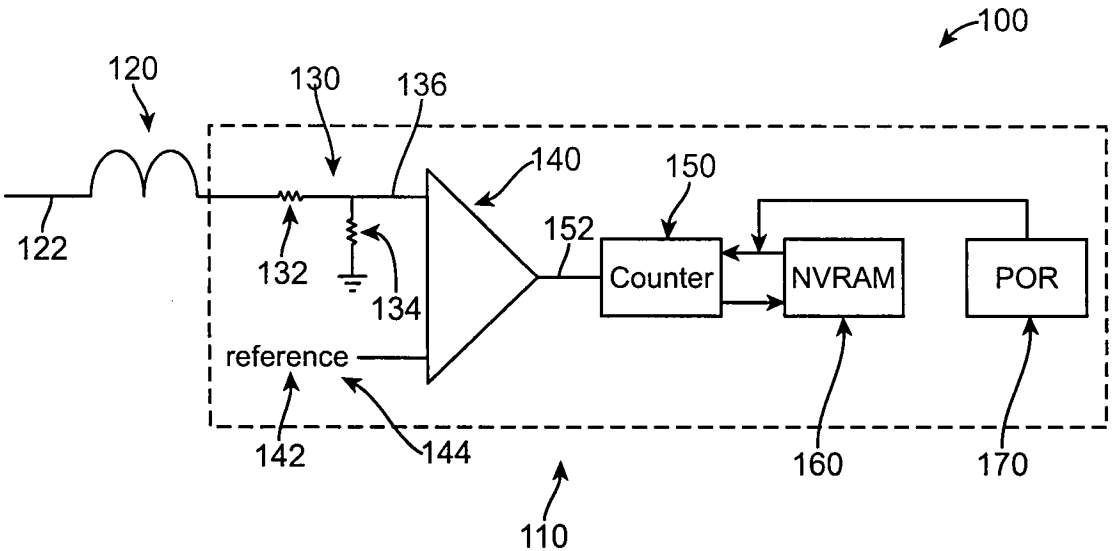
FIG. 2 is a block diagram of a circuit used to count AC line cycles to determine end-of-life of an LED bulb.

FIG. 2 is a block diagram of a microcontroller 100 and the circuitry 110 of the microcontroller 100 used to count AC line cycles to determine "end-of-life" of an LED bulb 10 as shown in FIG. 1. In accordance with an exemplary embodiment, the circuit 110 includes an input (or input signal) 120 from a rectified AC line 122. The signal 120 is scaled by a resistor divider 130 comprised of a first resistor 132 and a second resistor 134 to a level that is useful as a microcontroller input in the form of a scaled AC signal 136. Inside the microcontroller circuit 110 is a comparator 140, which receives the scaled AC signal or input 136 from the resistor divider 130. The scaled AC signal 136 is compared by the comparator 140 with a reference 142. In accordance with an exemplary embodiment, the reference 142 is an internal voltage reference 144. However, it can be appreciated that other references 142 can be used including but not limited to an internal current reference. Preferentially, if the scaled AC signal (or input) 136 transitions from below the internal voltage reference 144 to above it, the comparator 140 produces an output 152 in form of a pulse or signal, which is fed to a counter 150. It can be appreciated that in accordance with an alternative embodiment, the polarity could be reversed, or alternatively, the comparator 140 output 152 can be used to trigger an edge-detector (not shown).

The counter 150 counts line cycles (i.e., AC line cycles) during the entire time the light bulb 10 is on (i.e., when a source of power is being supplied to the bulb) producing a counter value. When the bulb 10 is turned off or "power down" (i.e., the source of power is removed or no longer provided to the bulb), the microcontroller circuit 110 off-loads (i.e., writes) the counter value to a non-volatile memory 160. The non-volatile memory 160 stores the sum of all the counter values (i.e., counts) to date during the time the light bulb is off. When the light bulb 10 is turned on or "power up", the counter value (or value) of the non-volatile memory 160 is loaded (or read) into the counter 150, so that the count may resume where the count was left off. In accordance with an exemplary embodiment, when the light bulb 10 is first turned on, the value of the non-volatile memory is preferably set to zero (0).

In accordance with an exemplary embodiment, when the value of the counter 150 reaches a pre-determined value, the microcontroller circuit 110 writes the value to the non-volatile memory 160 and shuts off the light bulb. If the input power to the bulb is toggled, the microcontroller circuit 110 tests the value in the non-volatile memory 160. If the value is at the pre-determined limit, the microcontroller circuit 110 prevents the bulb from turning on, and the bulb remains permanently "off", which ensures that once the bulb is "dead" (i.e., the bulb has reached the end of its useful life or "end-of-life"), it remains "dead". In accordance with an embodiment, the pre-determined limit can be randomly adjusted at production time to provide a plurality of lights bulbs 10 having variable end-of-life cycles or operational times. It can be appreciated that by varying the end-of-life cycles for a plurality of light bulbs, a scheme and/or method can be implemented which slightly varies the end-of-life condition from unit to unit (i.e., "light bulb to light bulb" and/or "location to location").

In accordance with an exemplary embodiment, the circuit 110 can also include a power-on reset (POR) generator or other suitable processor 170, which generates a reset signal when power is applied to the circuit 110, which ensures that the microcontroller 100 starts operating in a known state.

It will be apparent to those skilled in the art that various modifications and variation can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An end-of-life LED light bulb comprising:

an LED light bulb;

a microcontroller having a circuit configured to detect operational time of the bulb;

wherein the microcontroller is configured to disable the bulb upon reaching a preset amount of operational time and wherein the circuit is configured to compare an output of the circuit with a reference value; and wherein the reference value is randomly adjusted at production time.

2. An end-of-life LED light bulb comprising:

an LED light bulb;

a microcontroller having a circuit configured to detect operational time of the bulb;

wherein the microcontroller is configured to disable the bulb upon reaching a preset amount of operational time and wherein the microcontroller includes a non-volatile memory;

wherein the circuit is configured to compare an output of a counter with a reference value; and wherein the reference value is randomly adjusted at production time.

3. An end-of-life detecting light emitting diode (LED) light bulb comprising:

a shell;

a base connected to the shell, the base configured to receive an alternating current (AC);

an LED within the shell;

a microcontroller having a circuit, the circuit configured to detect operational time of the bulb, wherein the microcontroller is connected to the LED and wherein the microcontroller is configured to receive a rectified AC input based on the AC;

wherein the microcontroller disables the bulb based on reaching a preset amount of operational time; and wherein the microcontroller is configured to compare a counter value with a reference value, the reference value is randomly adjusted at production time.

4. The end-of-life LED light bulb of claim 3, wherein:

the microcontroller is configured to detect AC line cycles of the rectified AC input; and the operational time of the bulb is based on the detected AC line cycles.

5. The end-of-life LED light bulb of claim 4, the circuit further comprising:

a counter circuit, the counter circuit configured to count based on the detected AC line cycles wherein the counter value based on the detected AC line cycles.

6. The end-of-life LED light bulb of claim 3, wherein the microcontroller includes a non-volatile memory.

7. The end-of-life LED light bulb of claim 6, wherein the microcontroller is configured to read from the non-volatile memory at bulb power-up and the microcontroller is configured to write to the non-volatile memory at bulb power-down.

* * * * *